US005498854A

United States Patent [19]

McWilliams

[11] Patent Number: 5,498,854

[45] Date of Patent: Mar. 12, 1996

[54] RADIANT ELECTRIC HEATER

[75] Inventor: Kevin R. McWilliams, Stratford-on-Avon, United Kingdom

[73] Assignee: Ceramaspeed Limited, United Kingdom

[21] Appl. No.: 246,325

[22] Filed: May 19, 1994

[30] Foreign Application Priority Data

May 21, 1993 [GB] United Kingdom ..... 9310514

[51] Int. Cl.[6] ..... H05B 3/68

[52] U.S. Cl. ..... 219/464; 219/457; 219/466

[58] Field of Search ..... 219/457, 458, 219/459, 460, 463, 464, 465, 467, 468, 443, 445, 446, 466

[56] References Cited

U.S. PATENT DOCUMENTS

| | | | |
|---|---|---|---|
| 1,475,760 | 11/1923 | Fay | 219/463 |
| 2,029,573 | 2/1936 | Knapp | 219/463 |
| 3,277,279 | 10/1966 | Wei | 219/478 |
| 4,327,280 | 4/1982 | McWilliams | 219/464 |
| 4,347,432 | 8/1982 | Gossler | 219/449 |
| 4,357,523 | 11/1982 | Bleckmann | 219/464 |
| 4,371,780 | 2/1983 | Gossler | 219/464 |
| 4,414,465 | 11/1983 | Newton | 219/449 |
| 4,707,589 | 11/1987 | Brooks et al. | 219/464 |
| 5,051,561 | 9/1991 | McWilliams et al. | 219/463 |

FOREIGN PATENT DOCUMENTS

| | | | |
|---|---|---|---|
| 0164900 | 12/1985 | European Pat. Off. | H05B 3/74 |
| 0206597 | 12/1986 | European Pat. Off. | H05B 3/74 |
| 0429244 | 5/1991 | European Pat. Off. . | |
| 0503685 | 9/1992 | European Pat. Off. . | |
| 3327622 | 7/1985 | German Dem. Rep. | H05B 3/74 |
| 439571 | 12/1935 | United Kingdom . | |
| 2061679 | 5/1981 | United Kingdom . | |

*Primary Examiner*—Teresa J. Walberg
*Assistant Examiner*—Sam Paik
*Attorney, Agent, or Firm*—Ira S. Dorman

[57] ABSTRACT

A radiant electric heater for use in a smooth top cooker includes a base of electrical and thermal insulating material and two heating elements supported on the base. One of the heating elements is energisable independently of the other element, for example to permit the heater to be adapted to different size cooking utensils. A peripheral wall of thermal insulating material extends laterally around the heating elements and a dividing wall is arranged between the heating elements such that, in use, separate and distinct heating zones are formed on the smooth top of the cooker. The dividing wall is received in the base of electrical and thermal insulating material and is retained in the base by friction. The dividing wall may additionally be constructed and arranged as a barrier effectively only to thermal convection currents generated in the heater.

20 Claims, 3 Drawing Sheets

RADIANT ELECTRIC HEATER

This invention relates to a radiant electric heater for use in a smooth top cooker and to a smooth top cooker incorporating such a heater.

BACKGROUND TO THE INVENTION

In a smooth top cooker, a smooth top, normally of glass ceramic, overlies one or more heaters comprising a metal dish, for example of circular shape, in which is provided a base layer of thermal and electrical insulating material. One or more electrical heating elements is or are supported in the dish, such element or elements comprising coiled wire and/or electrically conducting strip and/or one or more infra-red radiating lamps, for example of tungsten-halogen form. A peripheral wall of a thermally insulating material, such as a ceramic fiber material or vermiculite, is normally provided around the heater and, when the heater is installed, the peripheral wall contacts the underside of the glass ceramic smooth top with the heating element or elements being spaced from the smooth top.

DESCRIPTION OF PRIOR ART

In order to accommodate cooking utensils of different base areas it is known to provide such a heater incorporating at least two heating elements which are independently energisable and separated by a dividing wall of thermal insulating material. In use, separate and distinct heating zones are formed on the smooth top of the cooker so as to enable the heated area of the cooker to be adapted substantially to cooking utensils having different sizes and/or shapes. Such a heater is described in GB-A-2 044 057.

With such an arrangement it is possible, for example, to provide a circular heater including a central heating element and an annular heating element surrounding the central heating element and separated from it by a circular dividing wall of thermally insulating material.

For heating a cooking utensil of small base area the central heating element is arranged to be energised alone. For heating a cooking utensil of large base area, the central and annular heating elements are both arranged to be energised together.

In the arrangement of GB-A-2 044 057, the dividing wall is selected by way of its materials and dimensions to optimise thermal isolation of the inner and outer heating zones from one another, the inner heating zone incorporating the central heating element and the outer heating zone incorporating the annular heating element. The dividing wall, which is typically of ceramic fiber material, is arranged to extend in height substantially up to the underside of the smooth top of the cooker and has a typical thickness of about 10 to 15 mm, such a thickness being of a similar order of magnitude to the peripheral wall of the heater. The material and dimensions of the dividing wall provide an efficient thermal insulation barrier between the inner and outer heating zones such that when only the central heating element is energised, thermal transmission by conduction, convection and radiation from the heated inner zone to the unheated outer zone is minimised. In this way, concentration of heat in the inner zone, that is within the confines of the dividing wall, is maximised, as is the efficiency of heating a cooking utensil placed on the smooth top and covering the area of the inner zone.

A disadvantage of such a known heater can be the substantial thickness of the dividing wall which, as already stated, is typically 10 mm or more. Such a thickness may, for example, be two, three, or more times the typical distance between adjacent rows of wire coils in a coiled wire heating element and from one aspect can result in a non-uniform temperature across that area of the glass ceramic surface of a cooker heated by the heater, when the elements in the zones on both sides of the dividing wall are energised. From another aspect, the thick dividing wall occupies a significant area of the heater and results in a reduction in available area inside the heater for the heating elements. This problem becomes severe when it is required to provide a heater having more than two mutually isolated heated zones, thereby necessitating two or more dividing walls.

OBJECT OF THE INVENTION

It is therefore an object of the present invention to provide a radiant electric heater for use in a smooth top cooker with a dividing wall which overcomes the above disadvantages.

SUMMARY OF THE INVENTION

According to the present invention there is provided a radiant electric heater for use in a smooth top cooker, the heater comprising a base of electrical and thermal insulating material; at least two heating elements supported on the base, at least one of which heating elements is energisable independently of the other element or elements; a peripheral wall of thermal insulating material extending laterally around the heating elements; and at least one dividing wall arranged between the heating elements such that, in use, separate and distinct heating zones are formed on the smooth top of the cooker, wherein the at least one dividing wall is received in the base of electrical and thermal insulating material and is retained therein by friction.

This permits the dividing wall to be considerably thinner than hitherto and, in certain embodiments, to be constructed and arranged as a barrier substantially only to thermal convection currents generated in the heater. Thus, the dividing wall need not, for example, be a barrier to thermal conduction. Consequently, the dividing wall is only required to be of sufficient thickness so as to maintain an upstanding, preferably self-supporting, position during operation of the heater and to comprise a material which will withstand the normal operating temperature range within the heater.

The dividing wall is maintained in its upstanding position by virtue of the dividing wall being received in the base layer of electrical and thermal insulating material and being retained therein by friction. Thus, the dividing wall may be partly embedded in the base of electrical and thermal insulation or may be received in a groove formed therein.

The dividing wall may be of a material selected without substantial regard for its thermal conductivity or thermal radiation transmittance or reflectance properties. Accordingly it is not required to comprise a thermally insulating material in the sense thereof generally accepted by the skilled person. The dividing wall may comprise a metal strip, although for electrical safety reasons it may be preferred that the wall comprises an electrically insulating material. Examples of suitable electrically insulating materials for the dividing wall are: fabrics incorporating glass fibers and/or ceramic fibers; ceramics; mica and other micaceous materials. Such a fabric may, if required, be impregnated or coated with a stiffening medium such as a solution of an alkali or alkaline earth silicate solution, or a silica sol, which is subsequently dried.

The thickness of the dividing wall should typically not exceed 50 percent, and preferably not exceed 30 percent, of the thickness of the peripheral wall of the heater.

The thickness of the dividing wall is preferably less than 5 mm.

The dividing wall is preferably constructed of substantially uniform thickness. Its height may be substantially the same as, or slightly less than (for example by 1 to 2 mm) the height of the peripheral wall of the heater.

In a particular embodiment, two or more heating elements may be concentrically disposed relative to one another, a dividing wall being provided at the or each interface between the heating elements. In another embodiment, at least one of the heating elements may be disposed laterally of the other heating element or elements, a dividing wall being provided between the laterally disposed heating element and the other heating element or elements.

If desired, the dividing wall may also comprise, or include, or be coated with, a thermal radiation reflecting material, such as alumina.

The invention is now described by way of example with reference to the accompanying drawings in which:

DESCRIPTION OF PREFERRED EMBODIMENTS

Figure 1:
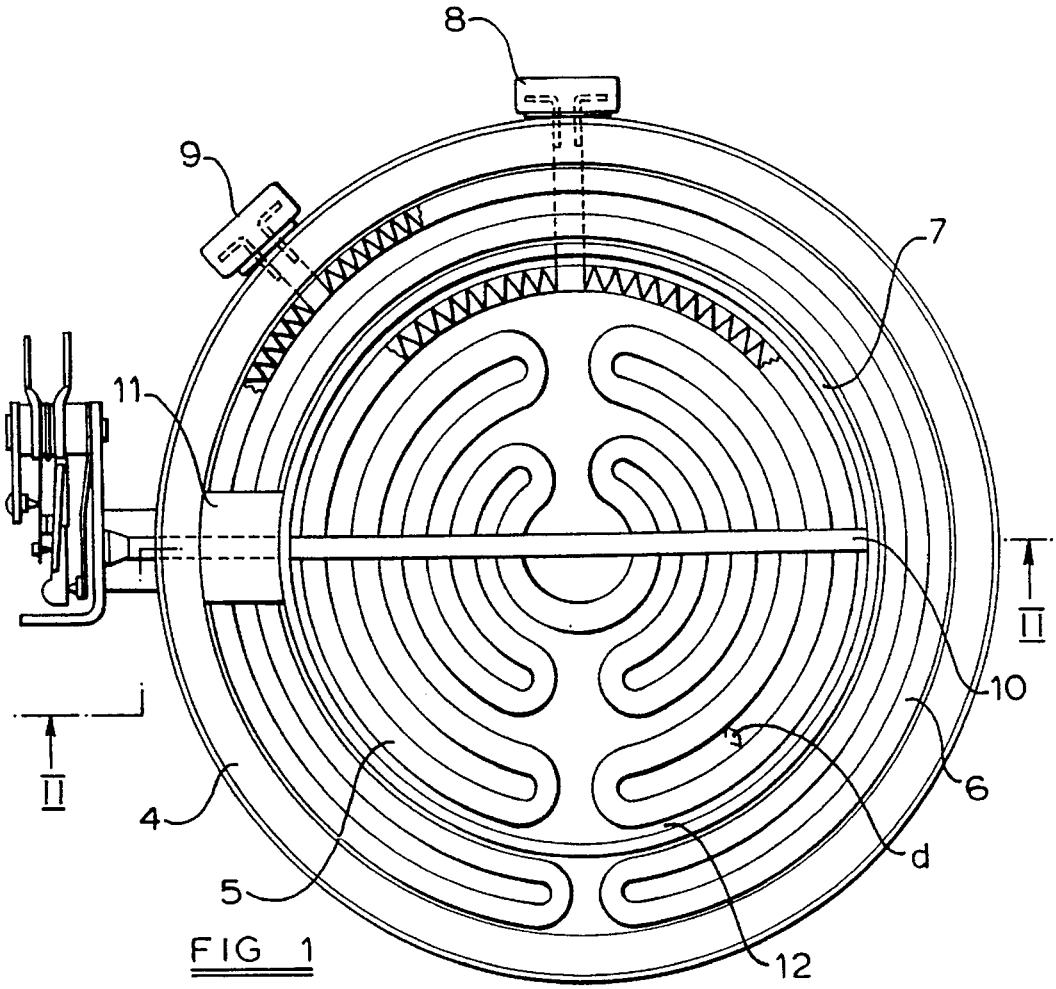
FIG. 1 is a plan view of one embodiment of a radiant electric heater according to the invention.
Figure 2:
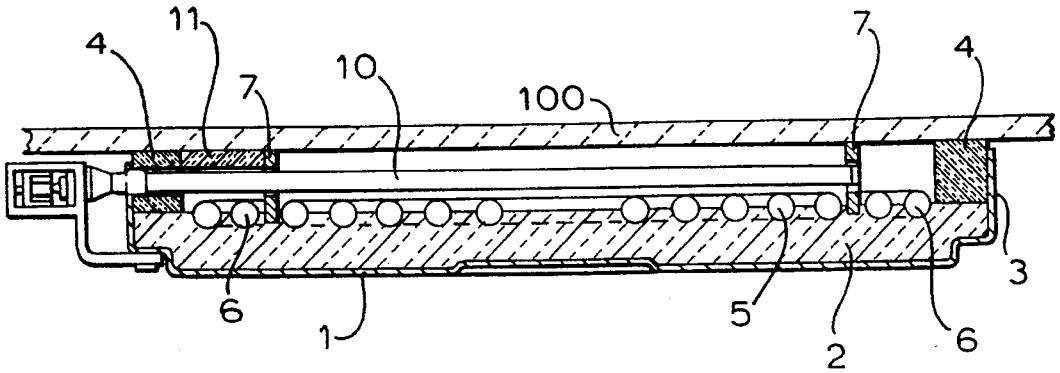
FIG. 2 is a section taken on line II—II of FIG. 1.

FIGS. 1 and 2 show a radiant electric heater which comprises a metal dish 1 containing a base 2 of electrical and thermal insulating material. The insulating material is preferably microporous thermal insulating material which is well known in the art and described, for example, in GB-A-1 580 909. Against the side 3 of the dish 1 is located a peripheral wall 4 of thermal insulation material comprising, for example, ceramic fiber material, vermiculite or microporous thermal insulation material. A typical thickness of the peripheral wall 4 is about 10 mm.

The heater is intended to be mounted in a smooth top cooker under a glass-ceramic cooking surface 100, with the top surface of the peripheral wall 4 in contact with the underside of the glass-ceramic cooking surface.

Two concentric electric heating elements 5 and 6 in the form of wire coils are located in grooves formed in the base 2. As an alternative to wire coils, the heating elements may be in the form of elongate electrically conductive strips, preferably corrugated, and partially embedded edgewise in the base 2. The heating elements are separated from each other by a circular dividing wall 7 having a height the same as, or slightly less than (for example by 1 to 2 mm), the height of the peripheral wall 4. The thickness of the dividing wall 7 is such that it fits into a gap 12 between the heating elements 5 and 6 whose width is substantially the same as the distance d between adjacent turns of the heating element 5. In practice, the thickness of the dividing wall 7 will not exceed 50 percent of the typical thickness of the peripheral wall 4 and preferably will not exceed 30 percent of the typical thickness of the peripheral wall 4. The thickness of the dividing wall 7 is suitably less than 5 mm.

The dividing wall 7 separates the total heating area defined by the peripheral wall 4 into a central zone and an annular zone. The heating element 5 in the central zone is operable independently of the heating element 6 in the annular zone, separate terminal connectors 8 and 9 being provided for elements 5 and 6 respectively.

The material and thickness of the dividing wall 7 is selected primarily with regard to preventing transmission of heat by thermal convection from the central zone, heated by element 5, to the surrounding annular zone in which is located the element 6. It is not therefore required to be a thermally insulating material in the generally accepted sense thereof and may comprise a metal. However, in the interest of electrical safety it is preferred that the dividing wall should comprise an electrical insulating material.

A particularly suitable material for the dividing wall 7 is a woven glass fiber fabric, e.g. of thickness about 1 mm or less. Such a fabric may, if desired, be stiffened by coating it, for example, with a sodium silicate solution or aqueous silica sol which is subsequently dried.

The dividing wall 7 could alternatively comprise a thin ring of a ceramic, ceramic fiber material or mica or a micaceous material.

The dividing wall 7 is located in position by partially recessing it into the surface of the base 2 so that the dividing wall is retained in the base by friction. The dividing wall 7 may either be urged into the surface of the base 2 or into a groove formed in the surface of the base 2. I have found that to retain the dividing wall in place by friction considerably facilitates manufacture and transportation of the radiant heater.

A well-known form of thermal cut-out device 10 is provided to extend across the heating element 5 in the central zone and is thermally isolated from the heating element 6 in the annular outer zone by means of a block 11 of thermal insulating material which surrounds the cut-out device where it crosses the outer zone. The cut-out device 10 is therefore responsive only to the heating element 5 in the central zone.

To assess the performance of the resulting heater a comparison was made with a heater of the prior art which was of the same construction apart from the dividing wall 7. In the prior art construction a dividing wall was provided comprising ceramic fiber thermal insulating material and having a thickness of about 10 mm. This thick dividing wall of the prior art was intended to minimise thermal transfer through it by conduction, convection and radiation. Both heaters were located beneath a glass-ceramic cook top, and two identical containers, each with one liter of water therein were placed on the glass-ceramic surface overlying the central zone of the heaters. The heating element 5 in the central zone of each heater was energised and the time taken for the water in each container to reach boiling point was measured. Very little difference in time was noted, the heater according to the invention with the thin dividing wall taking only a few seconds longer to bring the water to boiling point than the heater of the prior art.

By contrast, in a further experiment a heater without any dividing wall 7 was compared with a heater of the prior art. In this case the heater without the dividing wall took about one minute longer than the heater of the prior art to bring the water to boiling point.

Such experiments demonstrate that thermal convection is a prime thermal parameter to be considered in such a heater and the thin dividing wall of the present invention is an effective barrier to thermal convection currents.

The use of the thin dividing wall in the heater of the invention allows the spacing between the heating elements 5 and 6 in the central and outer zones to be reduced compared with the prior art. Consequently, when both heating elements are energised, a high degree of uniformity of temperature across the entire heater can be achieved.

A further advantage of the thin dividing wall is that heaters with more than two heating zones can readily be provided by incorporating two or more such dividing walls, without the need to create additional space for the dividing walls. This is primarily because the dividing walls can be inserted in spaces having dimensions such as those normally provided between adjacent rows of elements in a heating coil or strip. Thus the dividing wall according to the present invention gives considerably greater flexibility than has hitherto be available in the design of radiant electric heaters for smooth top cookers.

In addition to heaters incorporating heating elements in the form of wire coils or strips of metal or metal alloy, the invention is also applicable to heaters incorporating one or more halogen lamps instead of, or in addition to, one or more of the aforementioned heating elements.

If desired, the thin dividing wall 7 may comprise, include, or be coated with a thermal radiation reflecting material, such as, for example, alumina.

Figure 3:
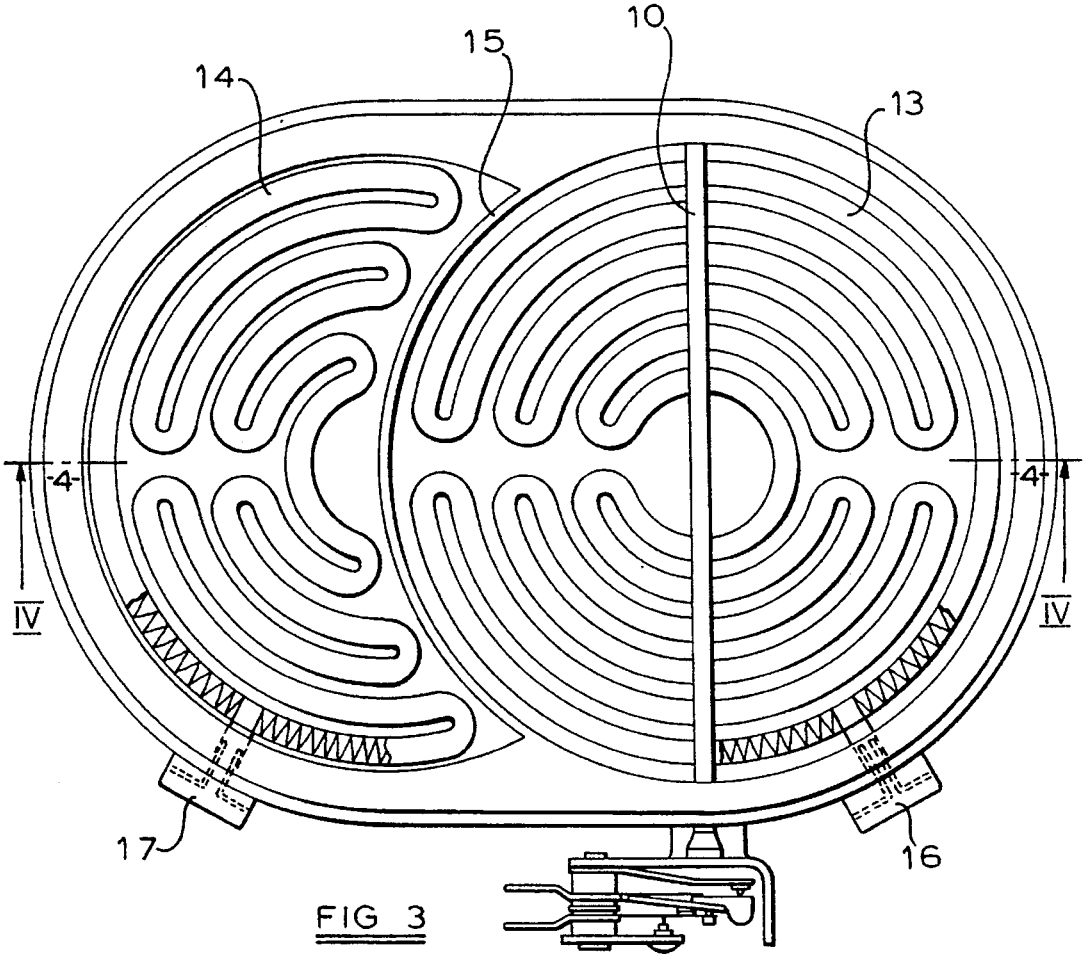
FIG. 3 is a plan view of another embodiment of a radiant electric heater according to the invention.
Figure 4:
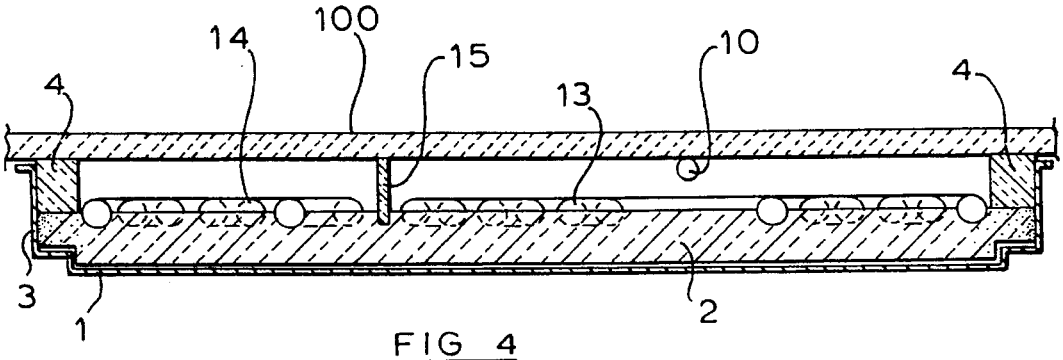
FIG. 4 is a section taken along the line IV—IV of FIG. 3.

The embodiment of FIGS. 3 and 4 is similar to that of FIGS. 1 and 2 and the same references are used to show the same or similar components. In the embodiment of FIGS. 3 and 4, a radiant electric heater comprises a metal dish 1 containing a base 2 of electrical and thermal insulating material. Against the side 3 of the dish 1 is located a peripheral wall 4 of thermal insulation material typically about 10 mm thick.

Two electric heating elements 13 and 14 in the form of wire coils or strips of metal or metal alloy are located in grooves formed in the base 2. The heating elements are separated from each other by an arcuate dividing wall 15 having the same height as, or slightly less than, the height of the peripheral wall 4.

The dividing wall 15 separates the total heating area defined by the peripheral wall into a circular zone and a crescent-shaped zone. The heating element 13 in the circular zone is operable independently of the heating element 14 in the crescent-shaped zone so as to create either a circular heating area or an oval heating area on the smooth top 100 of the cooker. Separate terminal connectors 16 and 17 are provided for heating elements 13 and 14 respectively.

The dividing wall 15 is partially recessed into the surface of the base 2 by urging it into the surface of the base or into a groove formed therein and is retained in the base by friction.

A thermal cut-out device 10 extends across the heating element 13 in the circular zone.

Figure 5:
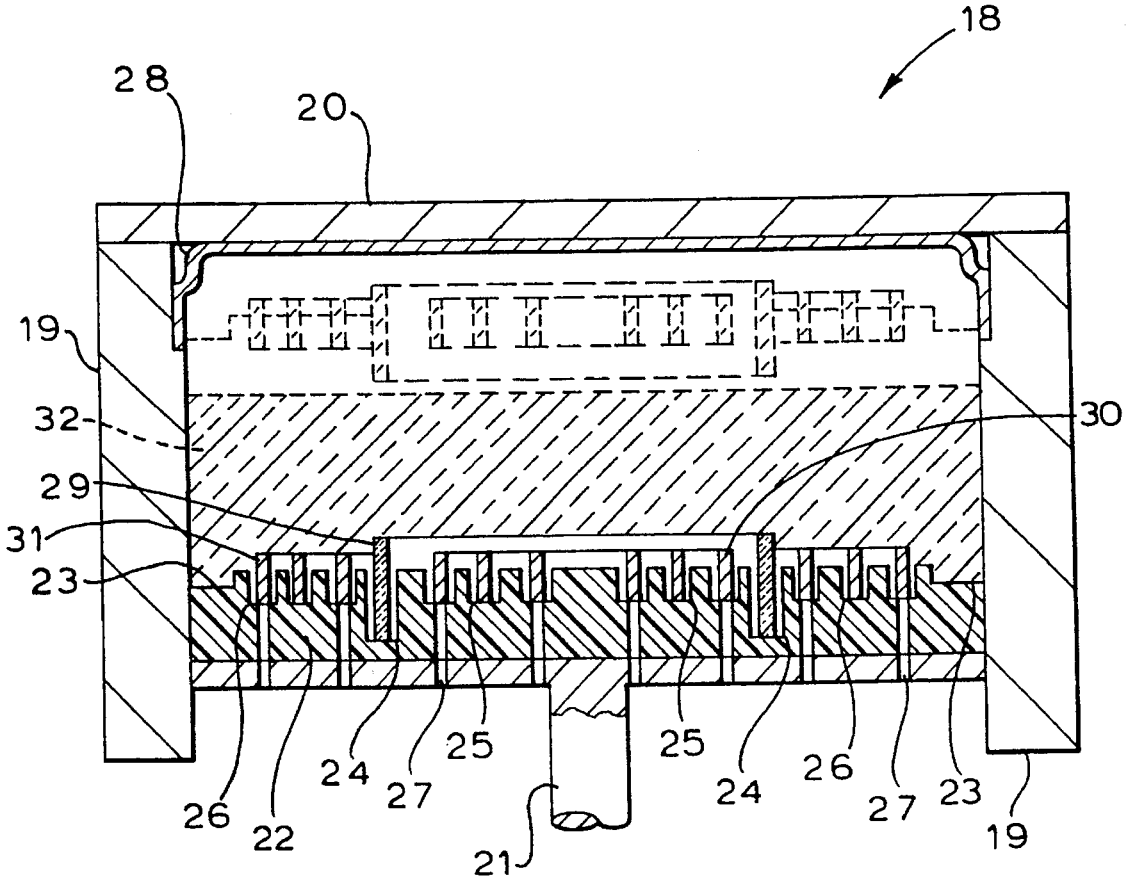
FIG. 5 is a schematic sectional view of an arrangement for manufacturing a radiant electric heater.

As an alternative to urging the dividing wall into the surface of the base 2 or into a groove formed therein, there is shown in FIG. 5 a press 18 for embedding the dividing wall into the base at the time the base is formed. As illustrated in FIG. 5, the heating elements can also be embedded in the base at the same time.

As can be seen from FIG. 5, the press 18 comprises a housing 19, a cover 20, a plunger 21 and a press tool 22. The press tool 22 may conveniently be machined from a plastics material such as polytetrafluoroethylene (PTFE) and has a stepped rim 23 and grooves 24, 25 and 26 formed in its upper surface. Groove 24 is shaped in the illustrated embodiment to correspond to the configuration of a generally circular dividing wall, groove 25 is shaped in the illustrated embodiment to correspond to the desired configuration of a generally circular heating element to be positioned within the confines of the dividing wall, and groove 26 is shaped in the illustrated embodiment to correspond to the desired configuration of a generally annular heating element to be positioned around the dividing wall. It will be clear, however, to the skilled person that numerous other configurations of dividing wall and heating elements can be employed without departing from the present invention. The depth of the grooves is selected to correspond to whatever proportion of the height of the dividing wall or heating element that is desired to be exposed in the resulting heater, i.e. is required not to be embedded in the base of thermal insulation material. Generally it will be desired that a major proportion of the height of the dividing wall and of the heating elements will be exposed.

Provision is made for air to escape from within the press 18, for example by way of passageways 27 extending through the press tool 22 and the plunger 21. The upper end of the housing 19 is recessed to receive the rim of a metal dish 28 which will form the support for the heater.

Operation of the press 18 commences with retraction of the plunger 21 to the position shown in FIG. 5. A generally circular dividing wall 29, for example of woven glass fiber material as hereinbefore described, is placed edgewise in the groove 24. An inner, generally circular, heating element 30, for example made from an elongate electrically conductive strip of corrugated form, is placed edgewise in the groove 25, and an outer, generally annular, heating element 31 similar to the heating element 30 is placed edgewise in the groove 26.

A predetermined quantity of powdery microporous insulation mixture 32 (shown in dashed line) is introduced into the press 18 on top of the press tool 22, the dividing wall 29, the inner heating element 30 and the outer heating element 31. The metal dish 28 is then placed in the recess in the upper end of the housing 19 and the cover 20 is closed and secured.

The powdery microporous thermal insulation material is described, for example, in GB-A-1 580 909, a typical composition being:

49–97 percent by weight pyrogenic silica 0.5–20 percent by weight ceramic fiber reinforcement 2–50 percent by weight opacifier (such as titanium dioxide)

0.5–12 percent by weight alumina

The press 18 is operated, for example hydraulically, to urge the plunger 21 and the press tool 22 towards the metal dish 28, thereby compacting the insulation material 32 into the dish 28. The material is compacted to a density of, typically, 300–400 kg/m$^3$, and the plunger 21 may be held in its final position for a dwell time of several seconds to several minutes if necessary.

The cover 20 is opened and the dish 28 containing the compacted insulation material 32, the dividing wall 29 and the heating elements 30 and 31 (shown in dashed lines in FIG. 5) is removed. The dividing wall and the heating elements are found to be partially embedded in the insulation material 32 and are retained in the insulation material by friction. A major proportion of the height of the dividing wall and of the heating elements is exposed above the surface of the insulation material, this proportion corresponding to the depth of the grooves 24, 25 and 26 in the press tool 22. The insulation material is found to have been firmly compacted around the dividing wall and the heating elements thereby securing the dividing wall and the elements firmly in place in partial embedment in the insulation material.

Assembly of the remaining components of the heater, for example the terminal connectors, peripheral wall, thermal cut-out device and a block of thermal insulation material if needed, as illustrated in FIGS. 1 and 2, may then be effected.

If it is desired to secure the dividing wall more firmly in the insulation material, apertures or recesses may be provided around the periphery of the dividing wall so as to be embedded in the thermal insulation material. It is found that insulation material enters the apertures or recesses and becomes compacted therein so as to secure the dividing wall more firmly.

If desired, the microporous thermal insulation material may comprise more than one layer, with a main layer of silica-based material being positioned adjacent the base of the metal dish and a surface layer of alumina-based material. The surface layer is preferably sufficiently thick for the embedded portions of the dividing wall and of the heating elements to be accommodated entirely within it.

A suitable composition for the alumina-based material comprises:

55–65 percent by weight aluminum oxide

5–15 percent by weight silica

25–35 percent by weight titanium dioxide

1–5 percent by weight ceramic fiber

The aluminum oxide is in the form of a pyrogenic, or fume, material such as that sold under the name Aluminum Oxide C by Degussa AG.

The layers may be formed in the metal dish in any suitable manner. For example, the material for the silica-based insulation material may first be introduced into the press and compacted using a first press tool, the insulation material being compacted to less than its final density. The dividing wall and heating elements may be inserted into a second press tool and the alumina-based insulation material may then be introduced into the press beneath the silica-based material partially compacted into the metal dish. The alumina-based material is then compressed onto the silica-based material with the second press tool and the two layers compacted to their final density while simultaneously securing the dividing wall and the heating elements in position in the alumina-based material. Alternatively, the two-layer arrangement can be manufactured in a single operation by introducing the alumina-based material into the press on top of the dividing wall and the heating elements and then introducing the silica-based material on top of the alumina-based material. The press is then operated to compact the two layers simultaneously and to secure the dividing wall and the heating elements in position.

Various other modifications may be made to the methods described above. Thus it is not essential for the heater to be manufactured in an inverted position. It may be manufactured by placing the powdery insulation material in the metal dish and then bringing the press tool, with the dividing wall and the heating elements held therein, downwardly onto the insulation material to compact it into the dish and to secure the dividing wall and the heating elements in the insulation material. Moreover, it is not necessary simultaneously to secure the dividing wall and the heating elements in the insulation material and the heating elements and/or the dividing wall may be secured subsequently to forming a fully or partially compacted layer of insulation material if desired.

The insulation material in one or more layers may be first compacted in the dish, preferably to less than the final compaction density, using the first press tool and the heating elements and dividing wall may then be urged into the insulation material by means of the second press tool, accompanied if necessary by final compaction of the insulation material.

I claim:

1. A radiant electric heater for use in a smooth top cooker, the heater comprising a base of electrical and thermal insulating material; at least two heating elements supported on the base, at least one of which heating elements is energisable independently of the other element or elements; a peripheral wall of thermal insulating material extending laterally around the heating elements; and at least one dividing wall arranged between the heating elements such that, in use, separate and distinct heating zones are formed on the smooth top of the cooker, wherein the at least one dividing wall is received in the base of electrical and thermal insulating material and is retained therein by friction.

2. A radiant electric heater according to claim 1, wherein the at least one dividing wall is constructed and arranged as a barrier substantially only to thermal convection currents generated in the heater.

3. A radiant electric heater according to claim 1, wherein the at least one dividing wall is partly embedded in the base of electrical and thermal insulation.

4. A radiant electric heater according to claim 1, wherein the at least one dividing wall is received in a groove formed in the base of electrical and thermal insulation.

5. A radiant electric heater according to claim 1, wherein the at least one dividing wall comprises a metal strip.

6. A radiant electric heater according to claim 1, wherein the at least one dividing wall comprises an electrically insulating material.

7. A radiant electric heater according to claim 6, wherein the electrically insulating material is selected from the group consisting of fabrics incorporating glass fibers and/or ceramic fiber, ceramics, mica and other micaceous materials.

8. A radiant electric heater according to claim 7, wherein the electrically insulating material comprises a fabric, which fabric is impregnated or coated with a stiffening medium.

9. A radiant electric heater according to claim 8, wherein the stiffening medium is selected from the group consisting of a solution of an alkali silicate, a solution of an alkaline earth silicate and a silica sol, the stiffening medium being dried subsequent to impregnating or coating the fabric.

10. A radiant electric heater according to claim 1, wherein the thickness of the at least one dividing wall does not exceed 50 per cent of the thickness of the peripheral wall of the heater.

11. A radiant electric heater according to claim 10, wherein the thickness of the at least one dividing wall does not exceed 30 per cent of the thickness of the peripheral wall of the heater.

12. A radiant electric heater according to claim 1, wherein the thickness of the at least one dividing wall is less than 5 mm.

13. A radiant electric heater according to claim 1, wherein the dividing wall is of substantially uniform thickness.

14. A radiant electric heater according to claim 1, wherein the height of the at least one dividing wall is substantially the same as the height of the peripheral wall.

15. A radiant electric heater according to claim 1, wherein the height of the at least one dividing wall is less than the height of the peripheral wall.

16. A radiant electric heater according to claim 1, wherein at least two of the heating elements are concentrically disposed relative to one another, a dividing wall being provided at each interface between the heating elements.

17. A radiant electric heater according to claim 1, wherein at least one of the heating elements is disposed laterally of the other heating element or elements, the at least one dividing wall being provided between the laterally disposed heating element and the other heating element or elements.

18. A radiant electric heater according to claim 1, wherein the at least one dividing wall comprises a thermal radiation reflecting material.

19. A radiant electric heater according to claim 1, wherein the at least one dividing wall is coated with a thermal radiation reflecting material.

20. A radiant electric heater according to claim 1, wherein the at least one dividing wall incorporates a thermal radiation reflecting material.

* * * * *